US006692410B1

(12) United States Patent
Lai

(10) Patent No.: US 6,692,410 B1
(45) Date of Patent: Feb. 17, 2004

(54) COMPACT STEP SIMULATOR WITH DOUBLE INERTIAL WHEELS

(76) Inventor: Fen-Ying Lai, P.O. Box 697, Feng-Yuan City 420 (TW)

( * ) Notice: Subject to any disclaimer, the term of this patent is extended or adjusted under 35 U.S.C. 154(b) by 26 days.

(21) Appl. No.: 10/099,984

(22) Filed: Mar. 19, 2002

(51) Int. Cl.[7] ..... A63B 69/16
(52) U.S. Cl. ..... 482/52; 482/57
(58) Field of Search ..... 482/51, 52, 53, 482/57, 70, 79, 80

(56) References Cited

U.S. PATENT DOCUMENTS 5,762,588 A * 6/1998 Chen ..... 482/57
5,779,599 A * 7/1998 Chen ..... 482/57
6,045,488 A * 4/2000 Eschenbach ..... 482/52

* cited by examiner

*Primary Examiner*—Stephen R. Crow

(57) ABSTRACT

A compact step simulator with double inertial wheels includes a rack combined with a front and a rear cylinder stands which are connected by a tilt plate and a vertical post on the top of which is a handle, an indicator and speed governor, a pair of inertial wheels coaxially and rotatably secured to two ends of an axis inside a hub each having an eccentric arbor symmetrically projected outward from the outer surface abutting the rim thereof, a pair of pedal seats having their front ends respectively and rotatably connected with the eccentric arbors and their rear ends sliding about on a pair of rollers on the rear cylinder stand and a pair of pedals secured to the top of the pedal seats abutting their front ends. Thereby, the feet of a user tread on the pedals, the inertial wheels are actuated to rotate at proper speed and the pedals are moved following an elliptic shaped locus.

6 Claims, 10 Drawing Sheets

COMPACT STEP SIMULATOR WITH DOUBLE INERTIAL WHEELS

BACKGROUND OF THE INVENTION

The present invention relates to healthy machines and more particularly to a compact step simulator with double inertial wheels which are rotated by treading up the pedals without needing external power source.

Typical step simulator in the market includes two types. The first type is a compact step simulator 60 (as shown in FIG. 1) which comprises a vertical post 61 with a handle on the top and an axis perpendicular to the lower end, a pair of pedals 62 and a pair of hydraulic struts 63 under the pedals 62. A front cylinder support 64 on the ground and centrally connects to the lower end of the vertical post 61. A rear cylinder support 65 on the ground connects to the lower portion of the vertical post 61 through tilt plate 66. The pedals 62 each has a front end 67 rotatably and respectively connected to the free ends of the axis. The hydraulic struts 63 each has one end connected to the inner periphery of the front cylinder support 64 and the other end connected to an underside of the pedals 62 respectively. This compact step simulator 60 has a small size or volume that is easy to move and/or packing for transportation. But the feet of the user can only move up and down so that the momentum is limitative and monotonous.

The second type is an elliptic shaped locus step simulator 70 (as shown in FIG. 2) which comprises a L-shaped rack 71, several positioning rods 72, 73 and 74 combined to pivot a main wheel 75 and a subordinate wheel 76 which is actuated by the main wheel 75 through a belt 751, a pair of cranks 77 having their front ends pivoted on the opposite sides of the main wheel 75 and their rear ends 771 respectively pivoted on a roller 772, and a pair of pedals 78 respectively secured to the top of the rear ends 771 of the cranks 77. When the feet of a user stand on the pedals 78 and tread on it, the cranks 77 move up and down and pedals move to follow an elliptic shaped locus. The momentum is therefore increased. Because of that the subordinal wheel 76 is indispensable to slow down the rotation speed of the main wheel 75, the volume of this step simulator should be enlarged. Thus, it is inconvenient to pack for transportation.

SUMMARY OF THE PRESENT INVENTION

The present invent ion has a main object to provide a compact step simulator with double inertial wheels which either provides a small size and/or provides an elliptic shaped locus movement for the pedals in order to achieve better exercise result.

Another object of the present invention is to provide a compact step simulator with double inertial wheels in which a speed governor is provided to control the rotation speed of the inertial wheels.

Further object of the present invention is to provide a compact step simulator which is easy to move and convenient to pack for transportation.

Accordingly, the compact step simulator of the present invention comprises generally a rack combined with a front cylinder stand, a rear cylinder stand, a tilt plate connected the front and rear cylinder stands and a vertical post projected upward from the middle of the front cylinder stand which includes a handle, an indicator and a speed governor on the top a pair of inertial wheels coaxially and juxtaposedly connected to an axis in a hub which is positioned at the junction point between the vertical post and the tilt plate, a H-shaped resistance plate or brake pivoted to an axial tube under the tilt plate and connected to the speed governor through a wire having which has a friction surface contacted to the rim of the inertial wheels respectively, a pair of pivots spacedly projected upward from the top of the rear cylinder stand each having a roller rotatably secured to the top, a pair of pedal seats each having an axial hole in front end respectively pivoted on a pair of arbors at outer surface of the inertial wheel abutting the rim and a rear end sliding about the top of the rollers of the pivots and a pair of pedals respectively secured to the top of the pedal seats. When a user treads the pedals, the inertial wheels begin to rotate and the eccentric arbor causes the pedal to follow an elliptic shaped locus to move in order to achieve the feet exercise result.

The present invention will become more fully understood by reference to the following detailed description thereof when read in conjunction with the attached drawings.

DETAILED DESCRIPTION OF THE PREFERRED EMBODIMENT

Figure 1:
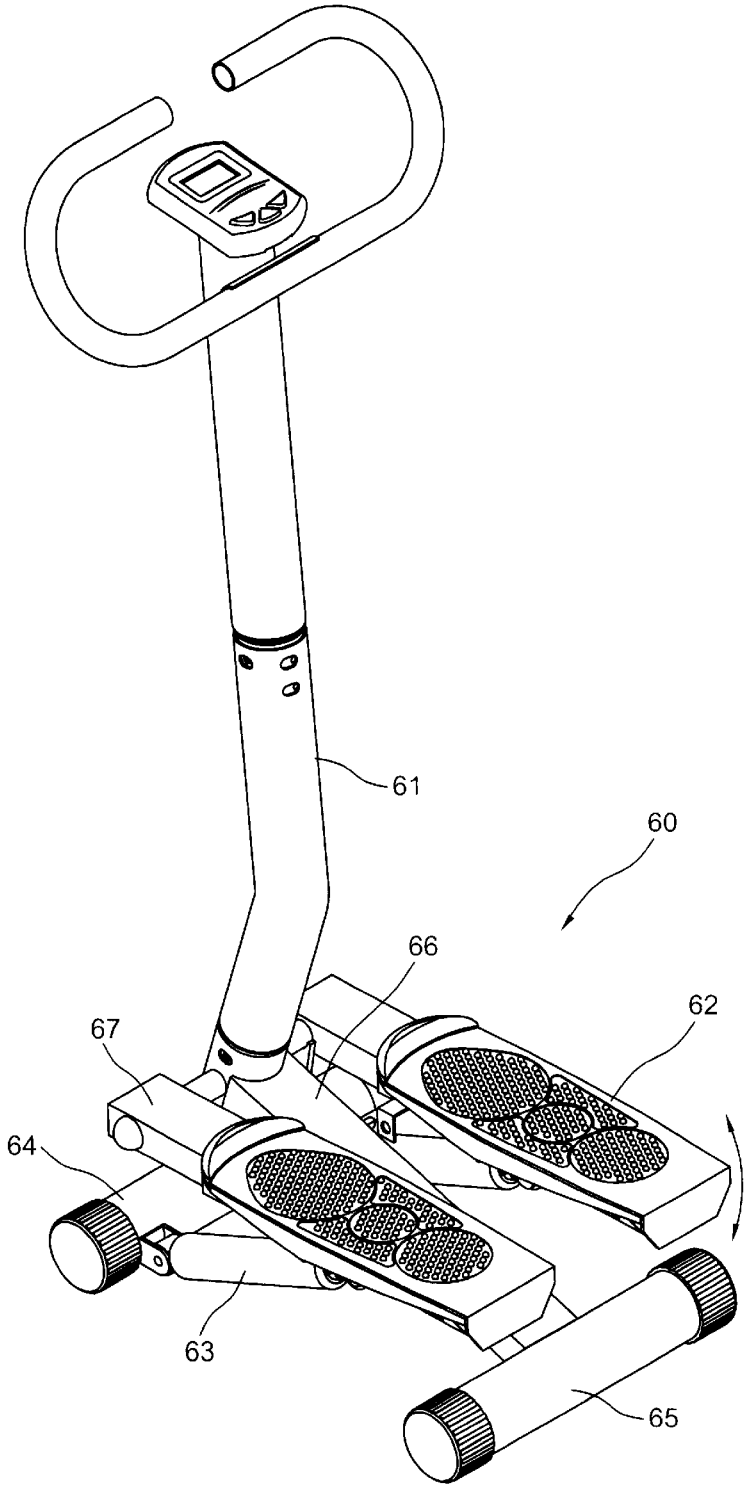
FIG.1 Prior Art
FIG. 1 is a perspective view to show a compact step simulator according to a prior art.

With reference to FIGS. 3 to 6 of the drawings, the compact step simulator of the present invention comprises general a rack 10, a pair of inertial wheels 15, a pair of pedal seats 152 and a H-shaped arcuate resistance plate or brake 19.

The rack 10 is combined with a vertical post 11 which has a bent lower portion connected to the middle of a front cylinder stand 12, a tilt plate 13 having a front end connected to a lower inner periphery of the vertical post 11 and a rear end connected to the middle of a rear cylinder stand 14 on the top of which is a pair of U-shaped pivots 141. The U-shaped pivots 141 are hollow and each is inserted within an adjusting plate 143, the adjusting plate 143 having a plurality of screw holes 1431. The U-shaped pivot 141 each has a fixing hole 1411 for enabling a fixing screw 155 to go through to fasten the adjusting plate 143. The fixing screws 155 having each has a swivel knob 1551 on its top for turning purpose. The adjusting plate 143 can be adjusted at different heights by choosing different holes 1431 and each has to a roller 142 rotatably secured to the top by bolts 1421 and nuts. The rollers 142 are provided for the pedal seats 152 to respectively place on their tops. A hub 131 is transversely disposed to the junction between the post 11 and tilt plate 13 into which is an axis 133 and a pair of bearings 132 respectively engage with two ends of the axis 133 inside the hub 131, a positioning plate 181 projected upward from the top of the tilt plate 13 abutting the hub 131. A handle 16, a speed governor 17 and an indicator 101 disposed to the upper portion of the vertical post 11. The indicator 101 demonstrates the operation time, the step number and the speed/minutes. The pair of inertial wheels 15 each has a central bore respectively and coaxially secured to two ends of the axis 133 and fastened by nuts and each has an eccentric arbor 151 projected outward from an outer surface abutting the rim and positioned symmetrically to each other.

The pair of pedal seats 152 each has an axial hole 1521 in front end movably engaged with the eccentric arbors 151 of the inertial wheels 15 respectively and secured by screws 1522 and washers and a pedal 153 on the top abutting the front end. The rear end of the pedal seats 152 are longitudinally sliding about on the top of the rollers 142 of the U-shaped pivots respectively.

Figure 6:
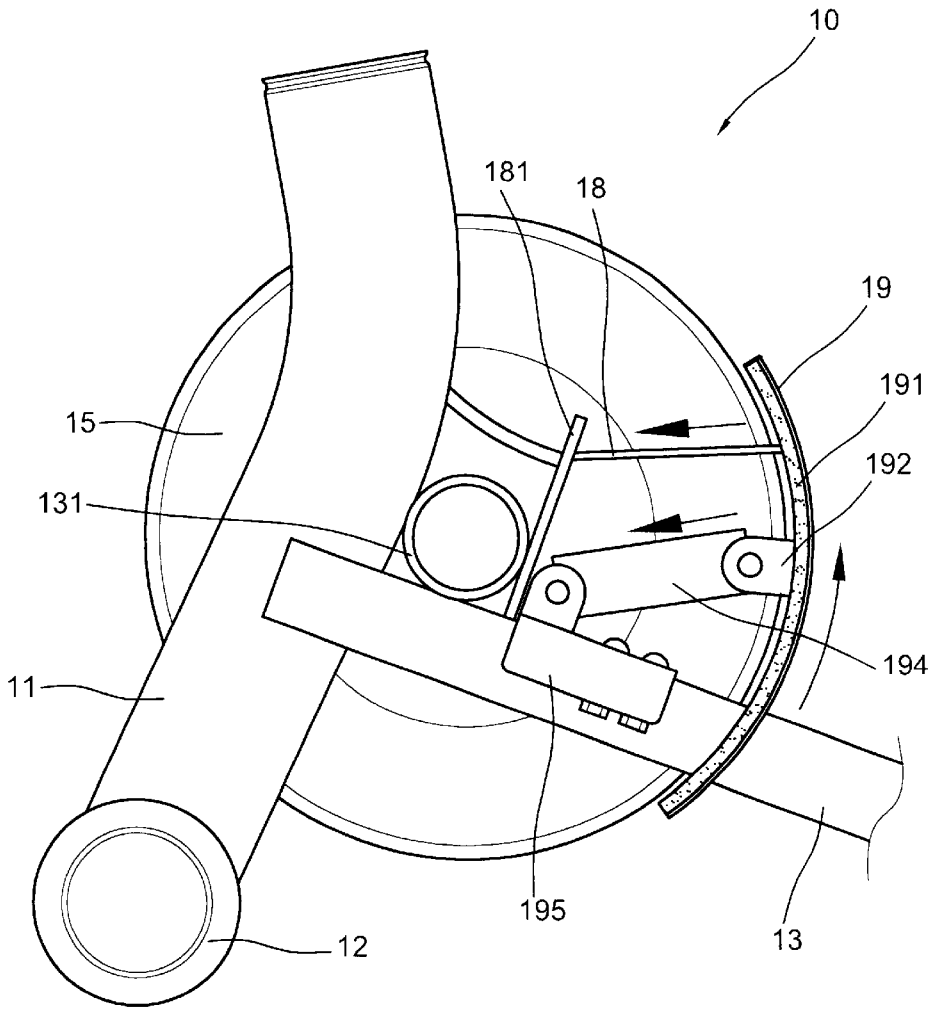
FIG. 6 is a side view to show the relationship between the H-shaped resistance plate and the inertial wheels.
Figure 7:
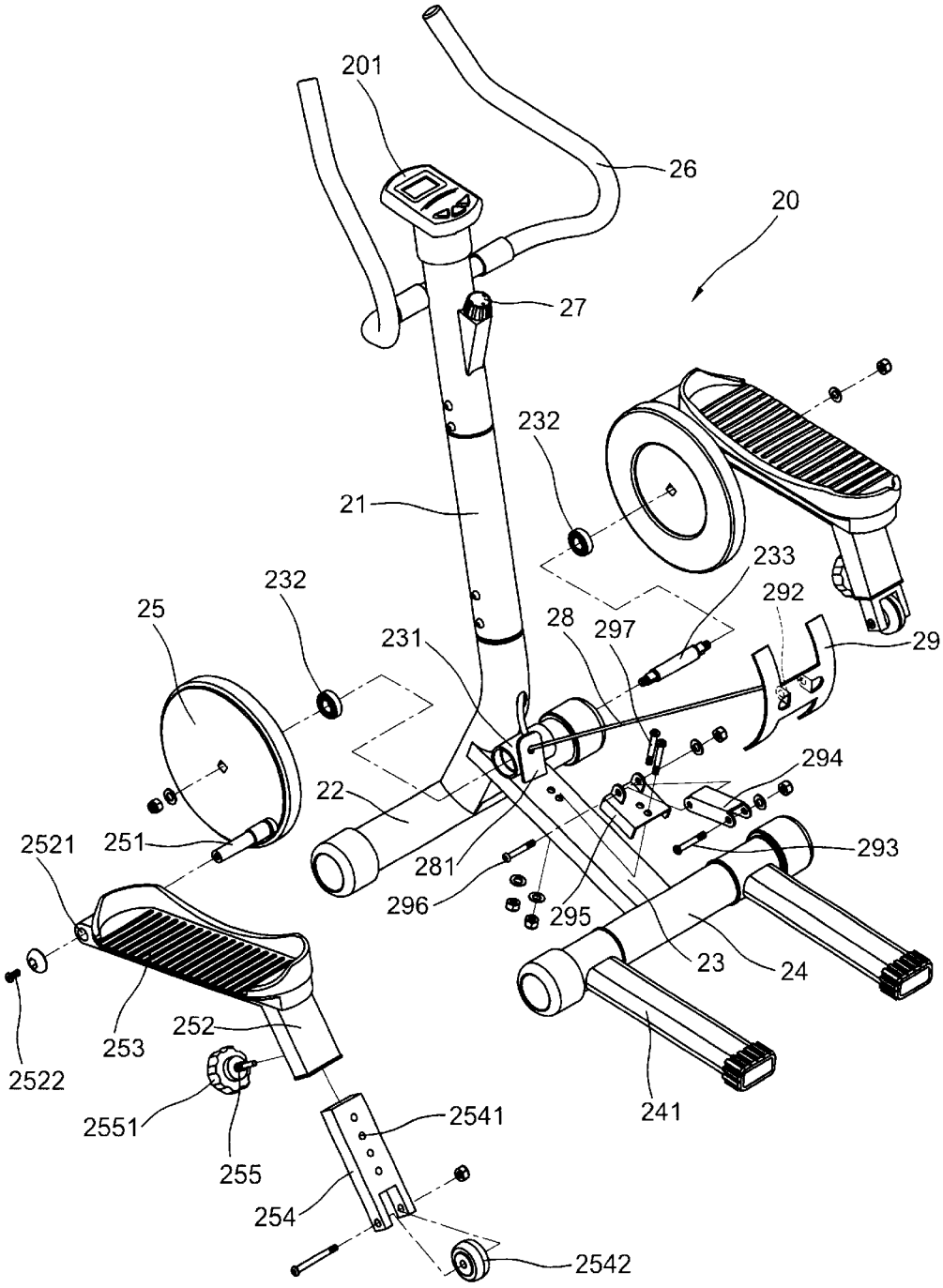
FIG. 7 is an exploded perspective view to show an alternate embodiment of the compact step simulator of the present invention.
Figure 8:
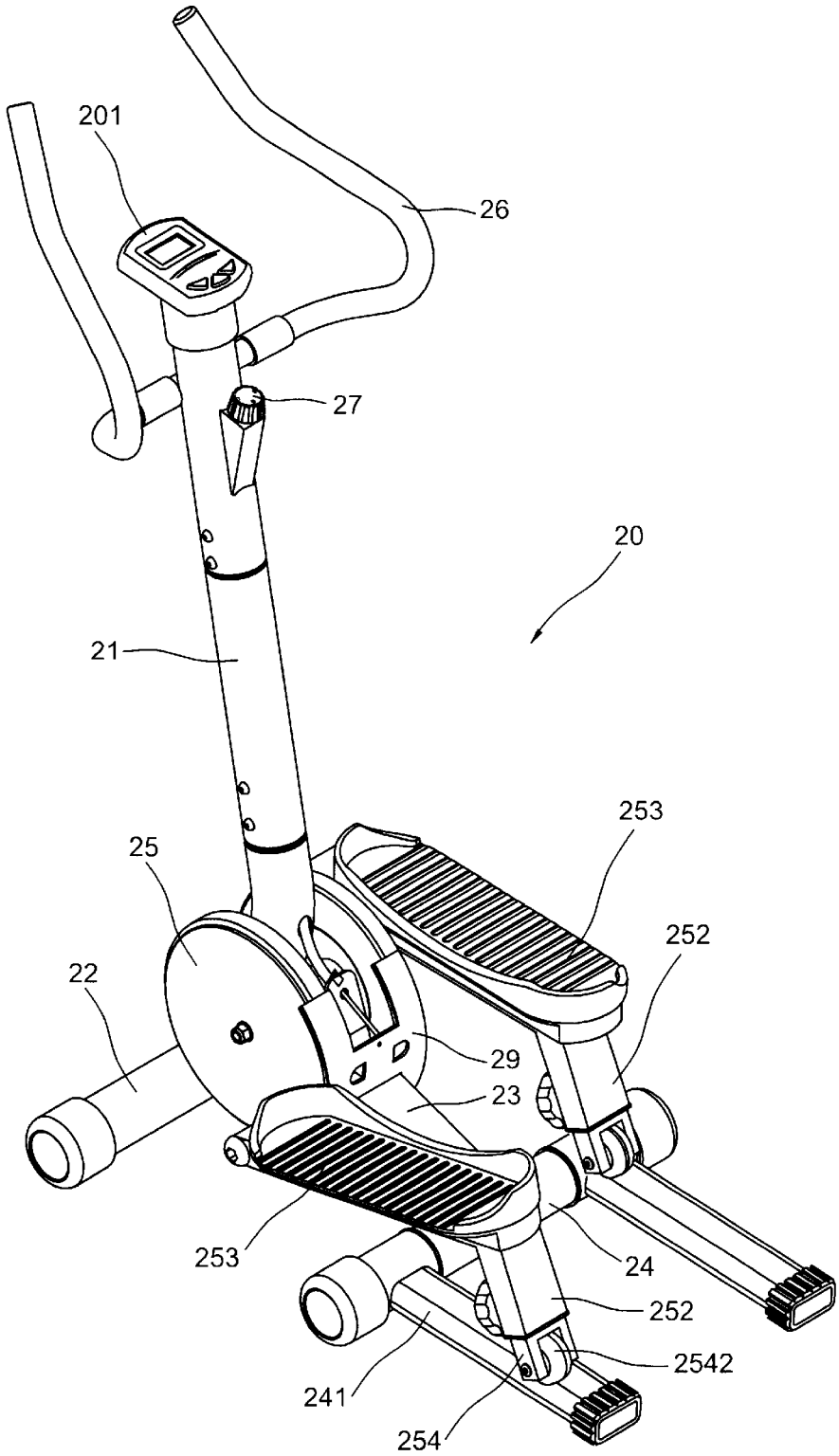
FIG. 8 is a perspective view to show the assembly of FIG. 7.
Figure 9:
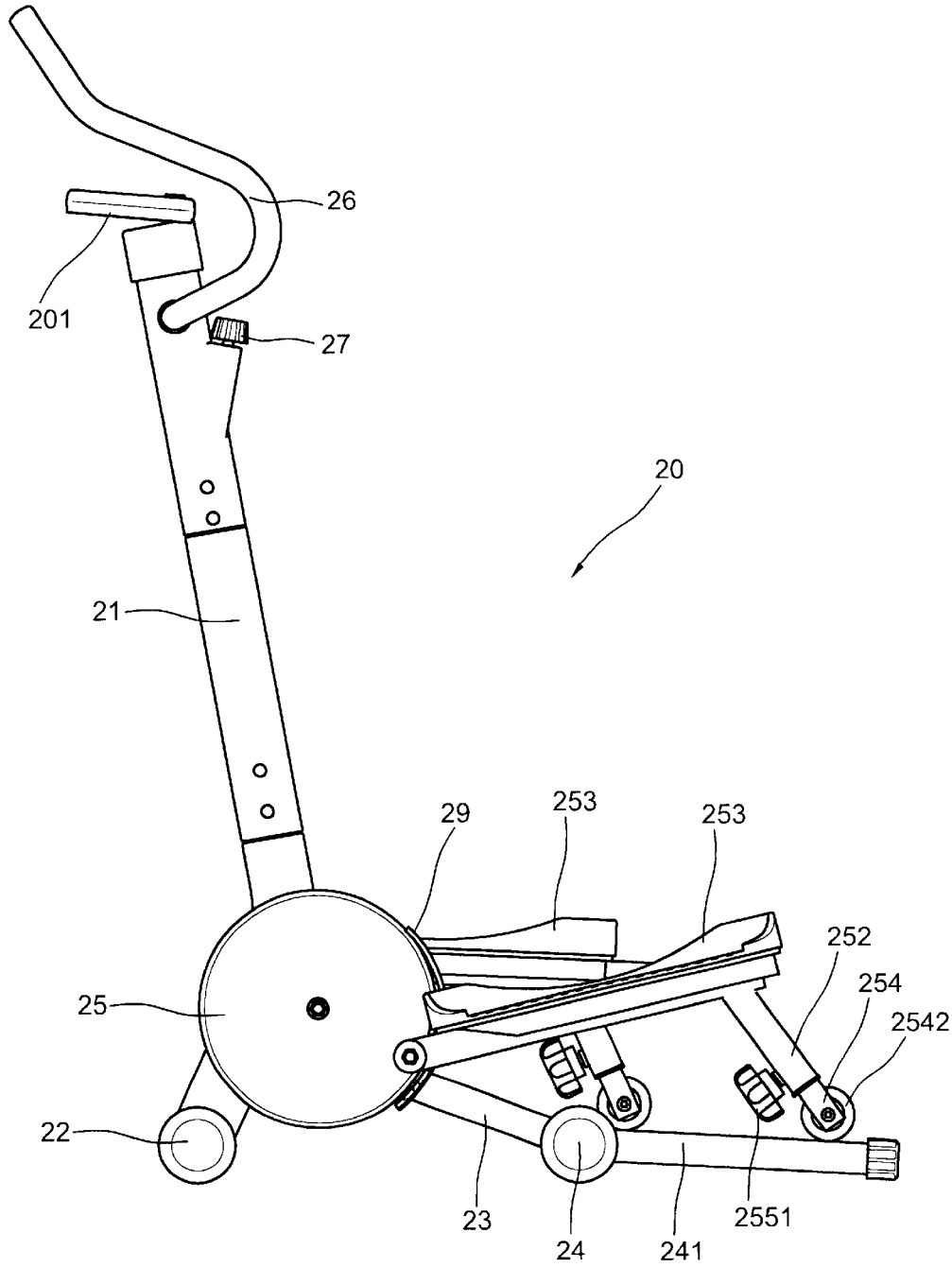
FIG. 9 is a side view of FIG. 8.
Figure 10:
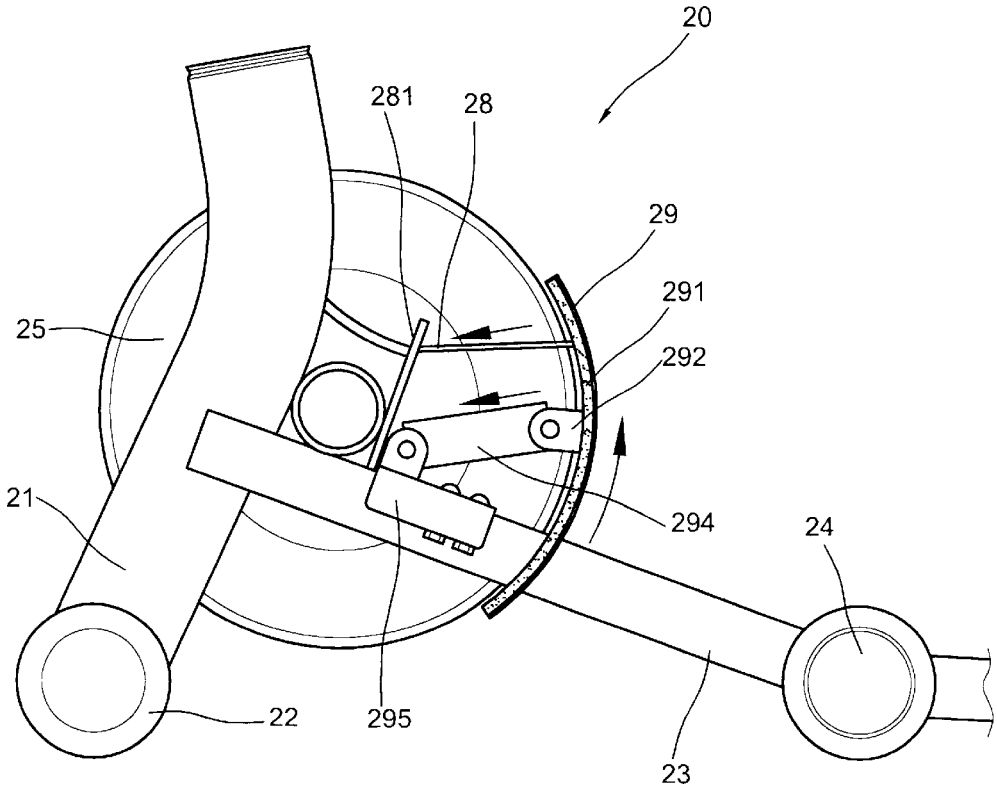
FIG. 10 is a side view to show the relationship between the H-shaped resistance plate and the inertial wheels.
Figure 11:
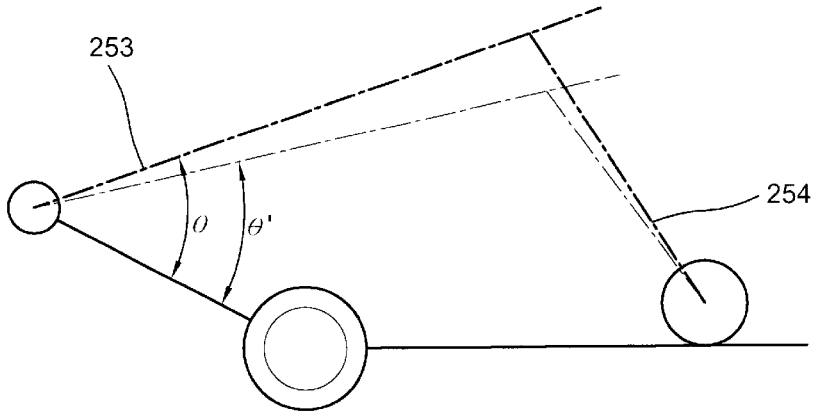
FIG. 11 is a flat view of the pedal seat in different angles in the second embodiment.

The H-shaped arcuate resistance plate 19 has a pair of ears 192 facing the vertical post 11. A U-shaped plate 194 is connected to the H-shaped resistance plate 19 through the ears 192 by a screw 193. The other end of the U-shaped plate 194 is connected to a positioning plate 195 on the top of the tilt plate 13 by a screw 196. The positioning plate 195 is fixed on the tilt plate 13 by a screws 197. A wire 18 connects the H-shaped arcuate resistance plate 19 with the speed governor 17 through the positioning plate 181. Further the H-shaped arcuate resistance plate 19 has a friction surface on inner side contacting to the rim of the inertial wheels 15 for frictionally slowdown the rotation of the inertial wheels 15 (as shown in FIG. 6).

When the feet of a user tread on the pedals 153, the weight of the user actuates the inertial wheels to rotate and the pedals 153 follow the pedal seats 152 to move up and down, forward and rearward to make an elliptic shaped locus movement. The rear end of the pedal seats 152 slide about on the rollers 142 of the U-shaped pivots 141. Because the friction force on the H-shaped arcuate resistance plate 19 can slow down the rotation of the inertial wheels 15, the user must apply certain strength to operate the pedals 153. However, the speed governor 17 can adjust the friction force in accordance with the speed demonstrated on the indicator 101.

Figure 2:
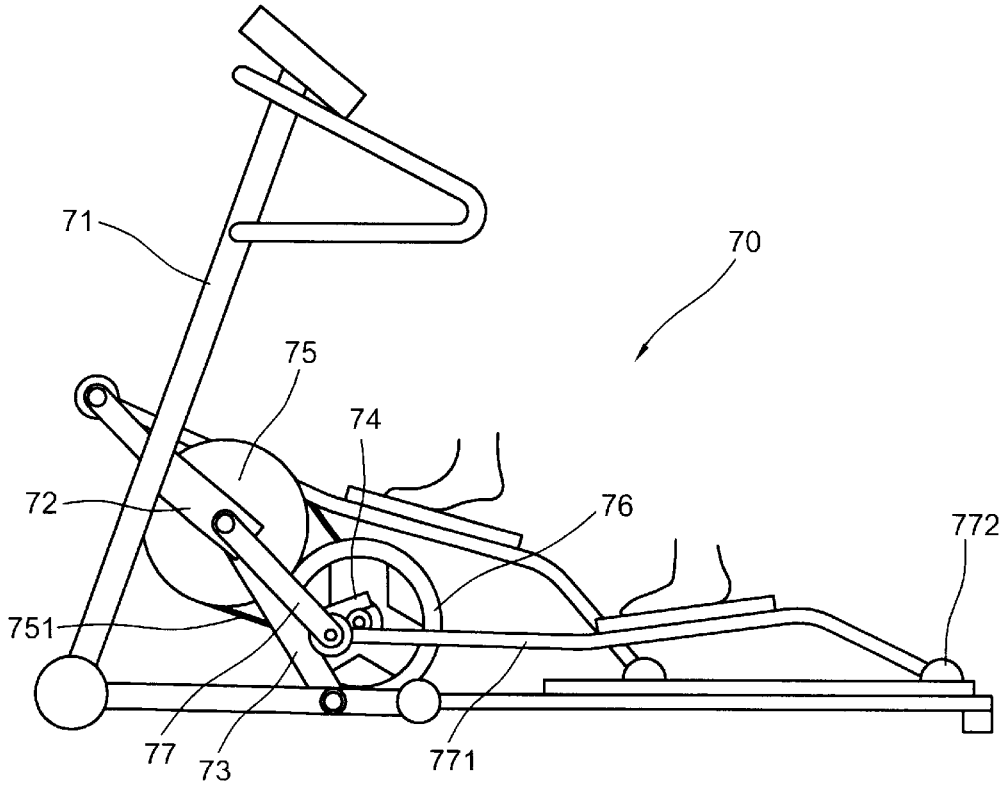
FIG.2 Prior Art
FIG. 2 is a side view to show an elliptic shaped locus step simulator according to another prior art.
Figure 3:
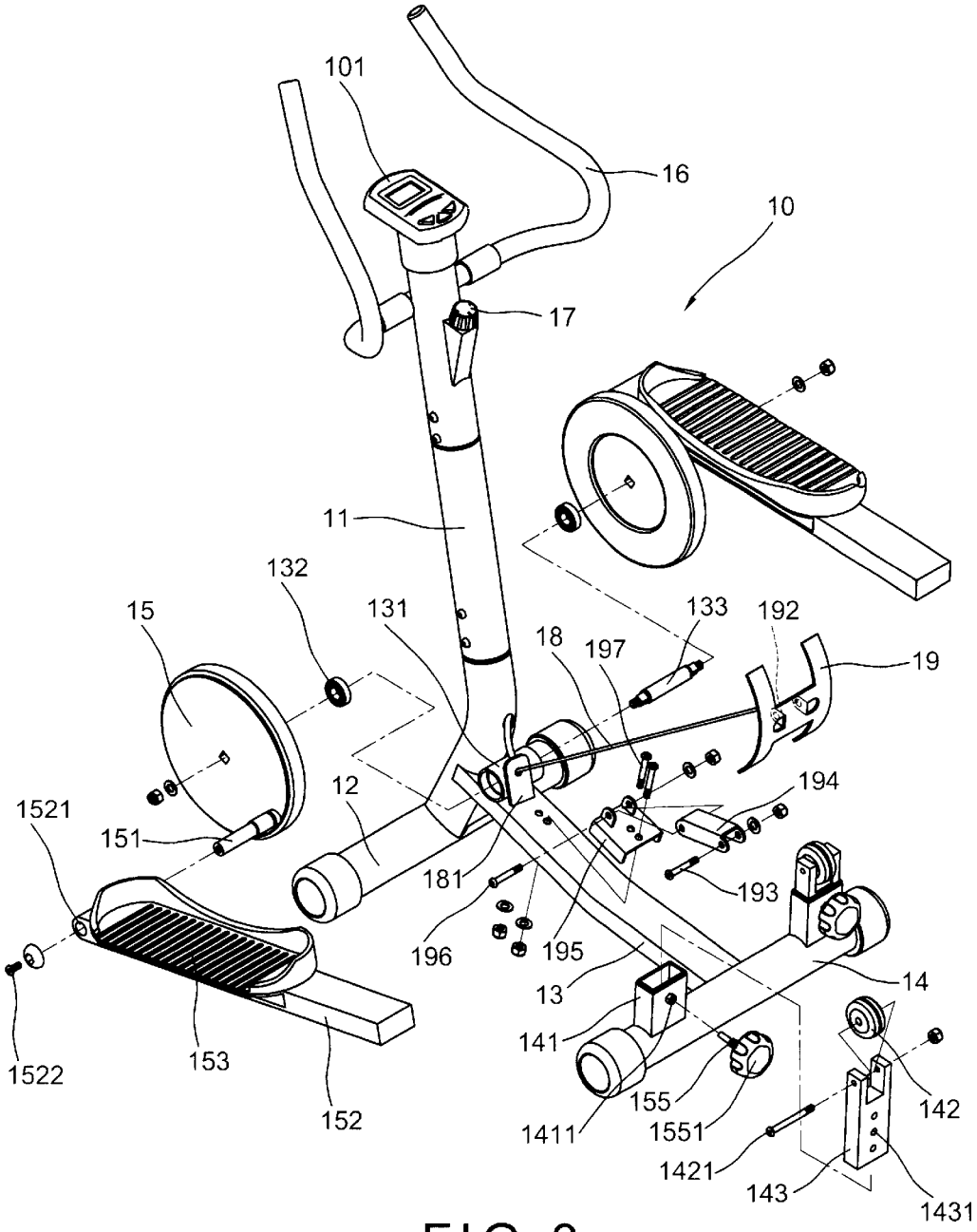
FIG. 3 is an exploded perspective view to show a compact step simulator of a preferred embodiment according to the present invention.
Figure 4:
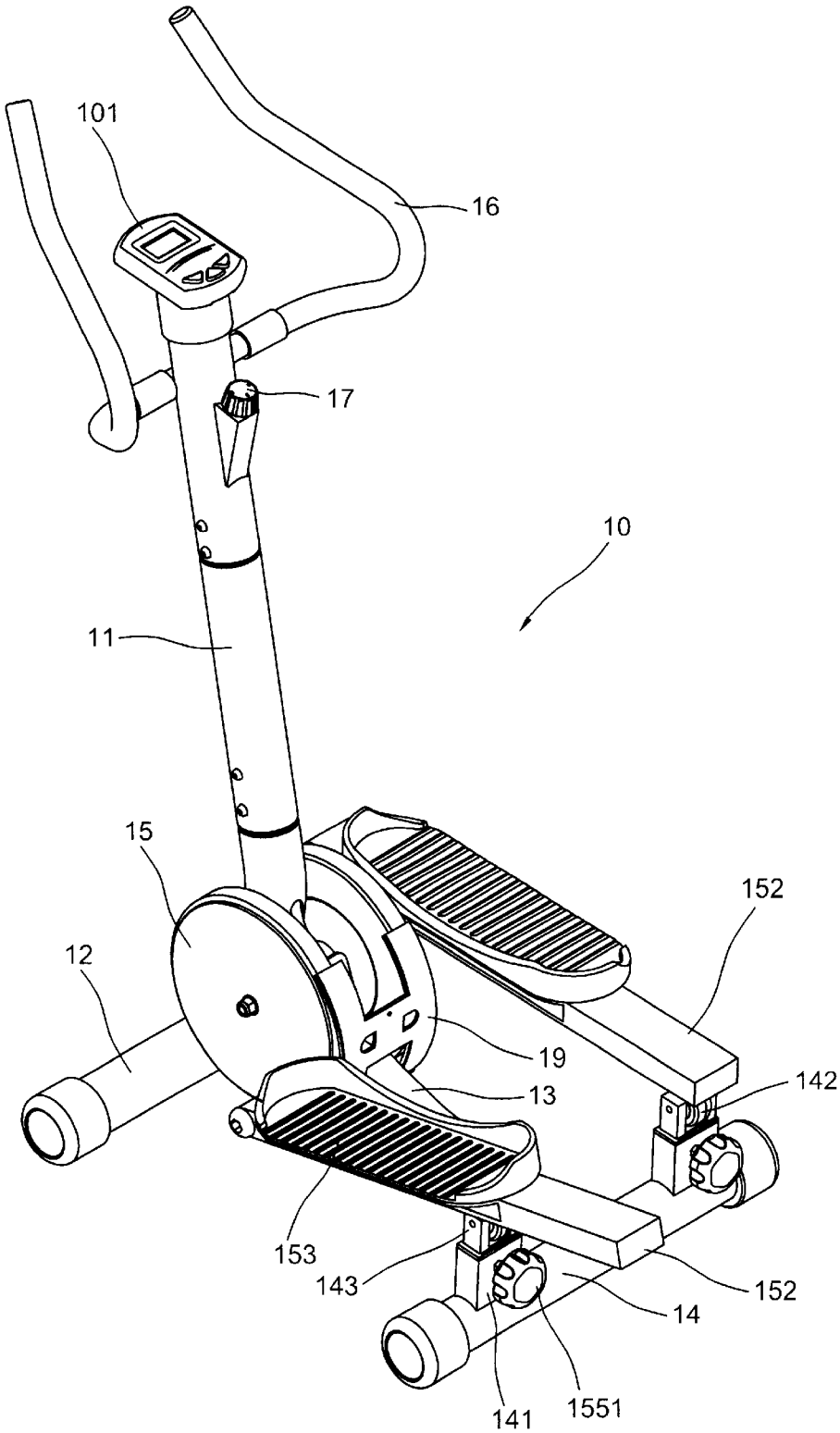
FIG. 4 is a perspective view to show the assembly of FIG. 3.
Figure 5:
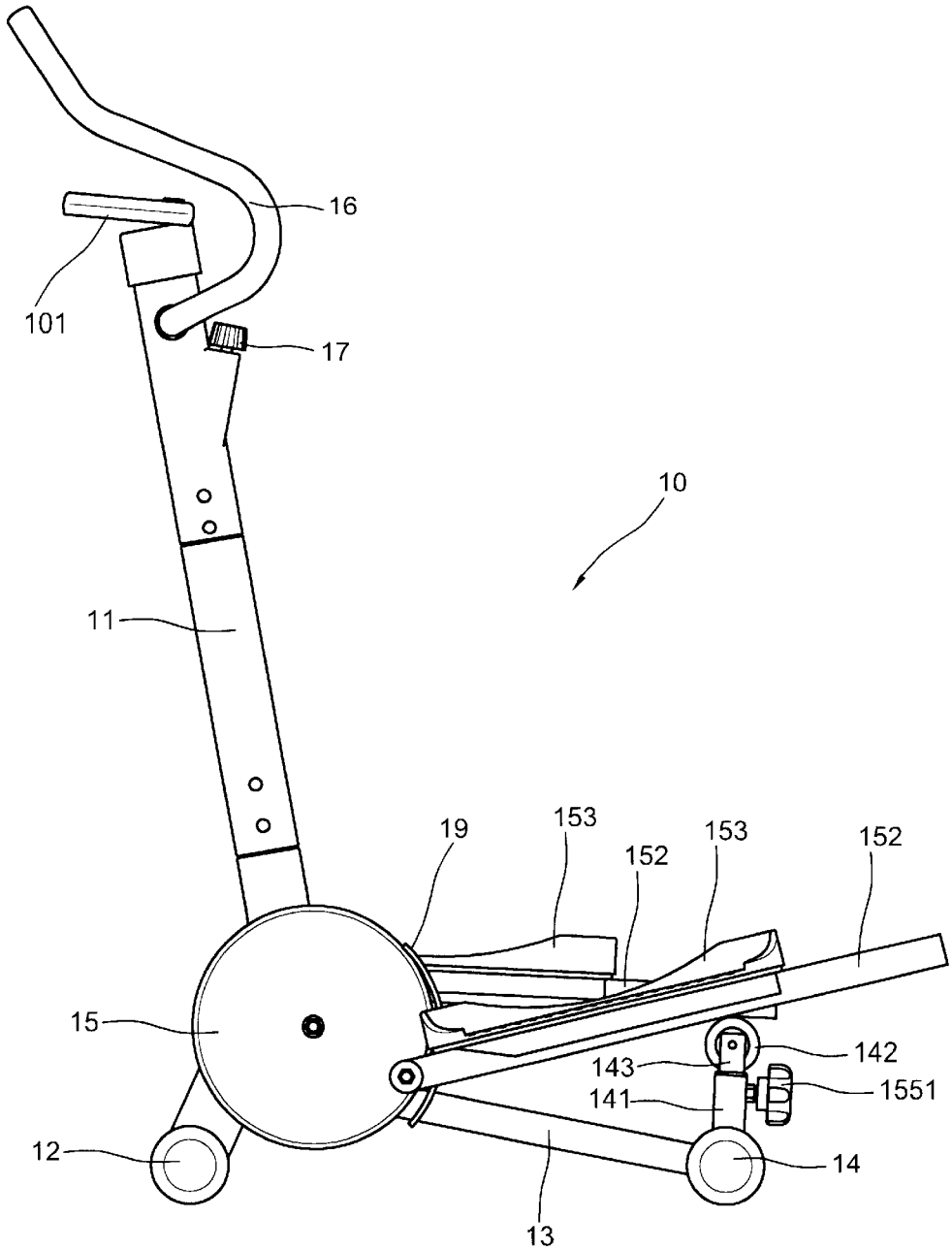
FIG. 5 is a side view of FIG. 4.

In comparison with the prior art step simulators described in FIGS. 1 and 2, the compact step simulator of the present invention achieves both a small sized structure and an elliptic shaped locus operation function.

Referring to FIGS. 7 to 11, an alternate embodiment of the compact step simulator of the present invention is provided. This embodiment comprises a rack 20, a pair of inertial wheels 25, a pair of pedal seats 253 and a resistance plate 29. The rack 20 comprises a vertical post 21 having a curved bottom, a front cylinder stand 22 connecting to the lower end of the vertical post 21. A tilt plate 23 is connected to the lower end of the vertical post 21. A rear cylinder stand 24 is connected to the rear end of the tilt plate 23. A pair of extensions 241 parallel to each other connect to the rear cylinder stand 24 perpendicularly. A hub 231 is disposed on the tilt plate 23 adjacent to vertical post 21. An axis 233 is placed inside a hub 231 with a pair of bearings 232 inserted into the two ends of the hub 231 respectively. A pair of inertial wheels 25 respectively connect to each end of the axis 233. An eccentric arbor 251 is disposed on the each inertial wheel 25 near its circumference. Each of the eccentric arbor 251 is connected to a pedal seat 252 through an axial hole 2521 at the front end of the pedal seat 252 and fixed by a screw 2522. A pedal 253 is disposed on each pedal seat 252. The pedal seat 252 is curved in shape and is connected to an adjusting plate 254 which is inserted into the pedal seat 252. A plurality of screw holes 2541 are spacedly formed in the adjusting plate 254. A pair of fixing screw 255 can be used to go through a hole of the pedal seats 252 and to screw into the screw holes 2541 on the adjusting plate 254, thus the length of the adjusting plate can be adjusted by choosing one of the screw holes 2541. A swivel knob 2551 is on the top of each of the fixing screws 255 for the purpose of turning the fixing screws 255. A rolling wheel 2542 is rotatably disposed at the end of each of the adjusting plates 254 and can roll about on the extensions 241. A positioning plate 281 is projected upward from the tilt plate 23 near the hub 231 and formed an angle of less than 90 degrees relative to the tilt plate 23, tilting towards the hub 231. A wire 28 goes through the positioning plate 281 having one end connected to a resistance plate 29, and another end gone all the way upwards inside the vertical post 21 and then connected to a speed governor 27, the function of the speed governor 27 is for adjusting the tightness of the wire 28. The resistance plate 29 is in curved H-shape, having a friction surface 291 on inner side and can contact with the curved circumference of the inertial wheels 25. A pair of ears 292 are disposed on the middle of the resistance plate 29 facing the vertical post 21 and secured by screws 293 with a U-shaped connecting plate 294. One end of the connecting plate 294 is fixed to a positioning plate 295 by a screw 296. The positioning plate 295 is fixed on the tilt plate 23 by a screws 297. The connecting plate 294 is provided to facilitate the resistance plate 29 to move in responding to the control of the speed governor 27, thus the purpose of braking the inertial wheels 25 is achieved. An indicator 201 is disposed on the top end of the vertical post 21 for showing time, number of stepping, speed, etc. The difference between this embodiment and the above embodiment is that this embodiment comprises the pedal seat 252 in curved shape with the rolling wheels 2542 rolled on the extensions 241.

The retraction means provided by the pedal seat 252 makes this embodiment suitable for users of various heights. As shown in FIG. 12, when the adjusting plate 254 is lengthened, it makes the heel end of the pedal 253 lifted upwards. When the adjusting plate 254 is shortened, it makes the heel end of the pedal 253 lowered, thus it is suitable for users of various heights and various stepping forces. Furthermore, the connecting plate 294 disposed underneath the resistance plate 29 provides a means for facilitating the resistance plates 29 to move, thus the braking effect of the resistance plates 29 can be adjusted by the speed governor 27.

Note that the specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

What is claimed is:

1. A compact step simulator with double inertial wheels comprising:

a rack having a front cylinder stand, a vertical post having bent lower portion projected upward from a middle of said front cylinder stand, a tilt plate having a front end connected to a lower inner periphery of said vertical post and a rear end connected to a middle of a rear cylinder stand, a pair of U-shaped pivots spacedly projected upward from top of said rear cylinder stand, a pair of rollers rotatably engaged in top of said U-shaped pivots through a pair of adjusting plate respectively and secured by bolts and nuts, said adjusting plates each having a plurality of screw holes spacedly formed in rear side a hub transversely disposed to a junction of said vertical post and said tilt plate, an axis disposed into said hub, a pair of bearings respectively wrapped on two ends of said axis inside said hub, a positioning plate projected upward from a top of said tilt plate abutting said hub, a handle, a speed governor and an indicator respectively disposed to upper portion of said vertical post;

a pair of inertial wheels each having a central bore respectively and coaxially secured to two ends of said axis by nuts and washers and an eccentric arbor projected outward from an outer surface abutting their rims thereof and positioned symmetrical to each other;

a pair of pedal seats each having an axial hole in front end movably engaged with said eccentric arbors respectively and secured by screws and washers, a rear end longitudinally sliding about on top of said rollers of said U-shaped pivots, and a pair of pedals respectively secured to a top of said pedal seats abutting the front end thereof;

an H-shaped arcuate resistance plate having a pair of ears on a middle portion thereof facing said vertical post, said ears rotatably connected to a U-shaped connecting plate other end of said connecting plate connected to a positioning plate located on a top of said tilt plate by a screws, a friction surface on inner side of said H-shaped arcuate resistance plate and contacting to a rim of said inertial wheels for frictionally slow down the rotation of said inertial wheels;

a wire connecting said H-shaped arcuate resistance plate with said speed governor on said vertical post through said positioning plate;

a pair of fixing screws insertible into a through hole in a rear side of each of said U-shaped pivots and screwed to one of the screw holes of said adjusting plates, said fixing screws each having a swivel knob at outer end;

whereby the height of said adjusting plates is adjustable.

2. The compact step simulator as recited in claim 1 wherein said indicator demonstrates the rotation time and speed of said inertial wheels and said step number of an operator.

3. The compact step simulator as recited in claim 1 wherein said speed governor controls the rotation speed of said inertial wheels.

4. A compact step simulator with double inertial wheels comprising:

a rack having a front cylinder stand, a vertical post having a bent lower portion projected upward from a middle of said front cylinder stand, a tilt plate having a front end connected to a lower inner periphery of said vertical post and a rear end connected to a middle of a rear cylinder stand, a pair of extensions spacedly extending rearward from said rear cylinder stand, a hub transversely disposed to a junction of said vertical post and said tilt plate, an axis disposed into said hub, a pair of bearings respectively wrapped on two ends of said axis inside said hub, a positioning plate projected upward from a top of said tilt plate abutting said hub, a handle, a speed governor and an indicator respectively disposed to upper portion of said vertical post;

a pair of inertial wheels each having a central bore respectively and coaxially secured to two ends of said axis by nut and washers and an eccentric arbor projected outward from an outer surface abutting their rims thereof and positioned symmetrically to each other;

a pair of pedal seats each having an axial hole in front end movably secured to said eccentric arbors respectively by screws and washer and a bent down rear end for rotatably engaging with a roller on distal portion of an adjusting plate and longitudinally sliding about on top of the extension of the rear cylinder stand respectively, said adjusting plates each having a plurality of screw holes spacedly formed in the body and a pair of pedals disposed on top of said pedal seats respectively abutting the front end thereof;

an H-shaped arcuate resistance plate having a pair of ears in a middle portion facing said vertical post, said ears being rotatably connected to a U-shaped connecting plate, the other end of said connecting plate connected to a positioning plate located on a top of said tilt plate by screws, a friction plate on inner surface of said H-shaped arcuate resistance plate contacting to a rim of said inertial wheels for frictionally slow down the rotation of said inertial wheels;

a wire connecting said H-shaped arcuate resistance plate with said speed governor on said vertical post through said positioning plate;

a pair of fixing screws insertible into a through hole in said best down rear end of each of said pedal seat and screwed to one of the screw holes of said adjusting plates, said fixing screw each having a swivel knob at outer end;

whereby said adjusting plates and the angle of said pedal seats are adjustable.

5. The compact stop simulator as recited in claim 4 wherein said indicator demonstrates the rotation time and speed of said inertial wheels and the step number of an operator.

6. The compact step simulator as recited in claim 4 wherein said speed governor controls the rotation speed of said inertial wheels.

* * * * *